US011535045B2

(12) United States Patent
Boland

(10) Patent No.: US 11,535,045 B2
(45) Date of Patent: Dec. 27, 2022

(54) ADJUSTABLE WEB HANDLING MECHANISM

(71) Applicant: Stuart Boland, Denver, CO (US)

(72) Inventor: Stuart Boland, Denver, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/294,207

(22) Filed: Mar. 6, 2019

(65) Prior Publication Data

US 2020/0282752 A1 Sep. 10, 2020

(51) Int. Cl.

| | |
|---|---|
| ***B41J 29/38*** | (2006.01) |
| ***B41J 15/04*** | (2006.01) |
| ***B41J 29/393*** | (2006.01) |
| ***B65H 20/02*** | (2006.01) |
| ***B65H 23/188*** | (2006.01) |

(52) U.S. Cl.
CPC ..... *B41J 15/046* (2013.01); *B41J 29/393* (2013.01); *B65H 20/02* (2013.01); *B65H 23/1888* (2013.01)

(58) Field of Classification Search
CPC ..... B41J 15/16; B41J 35/08; B65H 23/16
See application file for complete search history.

(56) References Cited

U.S. PATENT DOCUMENTS

| | | | | |
|---|---|---|---|---|
| 3,719,951 A | | 3/1973 | Kingsley et al. | |
| 3,946,800 A | | 3/1976 | Evans | |
| 4,202,723 A | | 5/1980 | Chaudhuri | |
| 5,226,577 A | | 7/1993 | Kohler | |
| 5,448,281 A | | 9/1995 | Walter et al. | |
| 5,455,668 A | | 10/1995 | De Bock et al. | |
| 5,549,401 A | | 8/1996 | Ishikawa et al. | |
| 5,791,541 A | * | 8/1998 | Jitsuishi | B65H 23/16 226/118.2 |
| 5,825,374 A | | 10/1998 | Albertalli et al. | |
| 6,007,471 A | | 12/1999 | Munk et al. | |
| 6,352,257 B1 | | 3/2002 | Todaro et al. | |
| 8,662,772 B2 | | 3/2014 | Muir et al. | |
| 8,814,313 B2 | | 8/2014 | Leighton et al. | |
| 9,046,827 B2 | | 6/2015 | Nakagaki et al. | |

(Continued)

FOREIGN PATENT DOCUMENTS

| | | |
|---|---|---|
| CN | 103837544 | 4/2016 |
| DE | 102009024912 | 2/2011 |

(Continued)

OTHER PUBLICATIONS

Stagnaro, A. (2008). Design and development of a roll-to-roll machine for continuous high-speed microcontact printing. Doctoral dissertation, Massachusetts Institute of Technology, 121 pages.

(Continued)

*Primary Examiner* — Lam S Nguyen
(74) *Attorney, Agent, or Firm* — Jaffery Watson Mendonsa & Hamilton LLP

(57) ABSTRACT

A web handling apparatus is disclosed. The web handling apparatus includes a first web guide to engage a print medium, a second web guide to engage the print medium to adjust a contact area between the first web guide and the print medium upon moving between a plurality of points on a guide path and a third web guide to engage the print medium to form a web path with the first web guide.

18 Claims, 5 Drawing Sheets

(56) References Cited

U.S. PATENT DOCUMENTS

| | | | | |
|---|---|---|---|---|
| 9,605,900 | B2 | 3/2017 | Boland et al. | |
| 9,701,106 | B2 | 7/2017 | Schulmeister | |
| 10,081,198 | B2 | 9/2018 | Boland et al. | |
| 2004/0140387 | A1 | 7/2004 | Ishida et al. | |
| 2005/0195270 | A1* | 9/2005 | Shih | B41J 35/08 347/217 |
| 2015/0054895 | A1* | 2/2015 | Suzuki | B41J 15/16 347/104 |
| 2016/0069028 | A1 | 3/2016 | Rieth et al. | |
| 2017/0096017 | A1 | 4/2017 | Fernando et al. | |
| 2017/0282601 | A1* | 10/2017 | Boland | B41J 15/165 |
| 2018/0088509 | A1* | 3/2018 | Musete | B65H 23/245 |
| 2018/0117936 | A1 | 5/2018 | Boland et al. | |

FOREIGN PATENT DOCUMENTS

| | | | |
|---|---|---|---|
| EP | 1780029 | | 5/2007 |
| GB | 2238040 | | 5/1991 |
| JP | 2000038244 | A | 2/2000 |
| JP | 2006021382 | A | 1/2006 |

OTHER PUBLICATIONS

Shin, K. H. (1991). Distributed control of tension in multi-span web transport systems. Doctoral dissertation, Oklahoma State University, 276 pages.

European Search Report for EP 20 160 646.4, 8 pages, dated Sep. 7, 2020.

* cited by examiner

ADJUSTABLE WEB HANDLING MECHANISM

FIELD OF THE INVENTION

The invention relates to the field of production printing systems, and in particular, to the handling of print media.

BACKGROUND

Entities with substantial printing demands typically implement a high-speed production printer for volume printing (e.g., one hundred pages per minute or more). Production printers include continuous-forms printers that print ink or toner on a web of print media stored on a large roll. An ink jet production printer typically includes a localized print controller that controls the overall operation of the printing system, and a print engine that includes one or more printhead assemblies, where each printhead assembly is controlled by a printhead controller and includes one or more printheads (or array of printheads). An individual ink jet printhead typically includes multiple tiny nozzles that discharge ink as controlled by the printhead controller. A printhead array is formed from multiple printheads that are spaced in series across the width of the web of print media.

While the ink jet printer prints, the web is quickly passed underneath the nozzles, which discharge ink onto the web at intervals to form pixels. A dryer, installed downstream from the printer, may assist in drying the wet ink on the web after the web leaves the printer. In an electrophotographic production printer, the imaged toner is fixed to the web with a high temperature fuser. Handling the web can prove challenging due to variation of a number of factors.

Web guides (such as rollers or bars) transfer the web through the dryer. Web guides often attain high temperatures, either directly from heaters or indirectly from contact with a heated web. In some instances, one or more heated web guides fail to maintain a set point temperature due to heat transfer exceeding heat generation capacity. This condition reduces the controllability of drying performance since the heated web guides need to operate at a maintained temperature. The major factors causing a particular web guide to be over capacity is related to a web guide's location within the drying process and a contact area(s) of web to the heated roller.

Accordingly, a mechanism to control a contact area between a web and a web guide surface to adjust heat transfer is desired.

SUMMARY

In one embodiment, a web handling apparatus includes a first web guide to engage a print medium, a second web guide to engage the print medium to adjust a contact area between the first web guide and the print medium upon moving between a plurality of points on a guide path and a third web guide to engage the print medium to form a web path with the first web guide.

BRIEF DESCRIPTION OF THE DRAWINGS

A better understanding of the present invention can be obtained from the following detailed description in conjunction with the following drawings, in which.

DETAILED DESCRIPTION

A mechanism to control a contact area between a web and a web guide surface in a printing system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
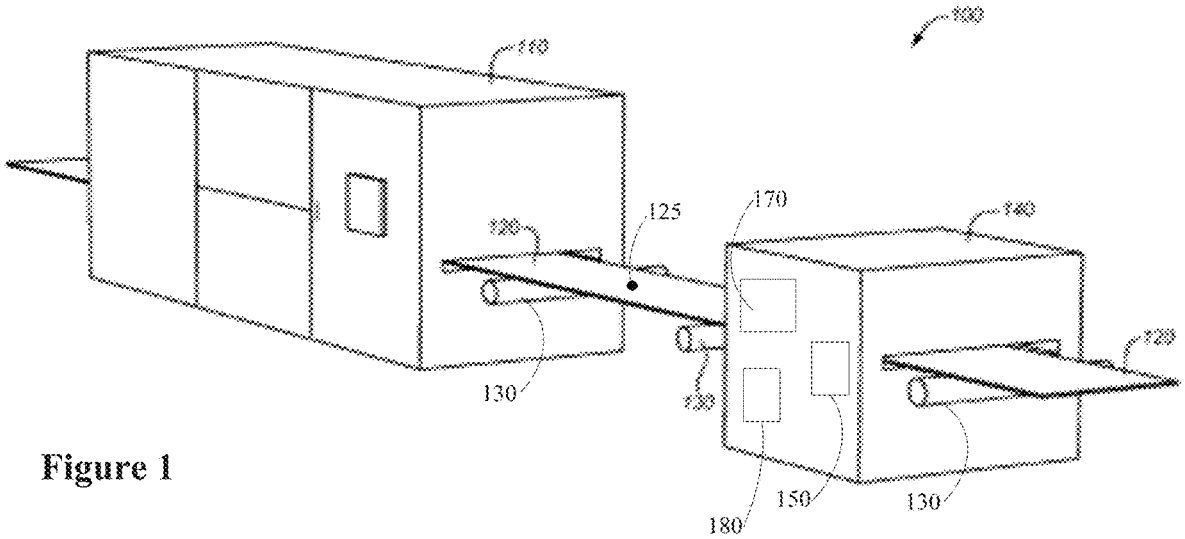
FIG. 1 illustrates one embodiment of a printing system.

FIG. 1 illustrates one embodiment of a printing system 100. Printing system 100 includes production printer 110, which is configured to apply ink onto a web 120 of continuous-form print media (e.g., paper). As used herein, the word "ink" is used to refer to any suitable marking material 125 (e.g., aqueous based inks, solvent based inks, UV curable inks, clear inks, oil-based paints, toners, etc.). Printer 110 may include an inkjet printer that applies colored inks, such as Cyan (C), Magenta (M), Yellow (Y), Key (K) black, white, or clear inks. The ink applied by printer 110 to the web 120 is wet. Thus, the ink may smear if not dried before further processing. One or more web guides (e.g., rollers) 130 position web 120 as it travels through, into or out of printing system 100.

To dry ink, printing system 100 also includes drying system 140 (e.g., a radiant heat dryer). In one embodiment, drying system 140 is an independent device downstream from printer 110. However, embodiments may feature drying system 140 being incorporated within printer 110. Web 120 travels through drying system 140 to dry the ink onto web 120. One or more web guides 130 position web 120 as it travels through, into or out of drying system 140. In embodiments, web guides 130 may be implemented via any combination of rollers, bars, or any other substantially constant radius curved surface.

Although discussed as a drying system, embodiments may feature implementation of system 140 as an independent web-handling device downstream from printer 110. Some embodiments may feature web handling system 140 upstream from printer 110. Further embodiments may feature a web-handling system 140 being incorporated within printer 110. In such embodiments, web 120 travels through web handling system 140 to be buffered, tensioned, cooled, wound, unwound, aligned, cut, slit, punched or perforated.

In one embodiment, web-guides 130 may include one or more heated web-guides to transfer web 120 through drying system 140. In such an embodiment, the heated web-guides are implemented as a component of the drying process. However, under certain conditions (e.g., when printing system 110 prints at higher speeds on heavier stocks, and with more ink) conductive heat transfer surfaces using heated web-guides may not be able to supply sufficient energy to maintain a set point surface temperature.

For instance, since web 120 is not yet heated and still wet upon entering dryer 140, the resulting temperature difference ($\Delta T$) between the web 120 and a heated web guide may be high, which results in a raised heat flux (q") from surface to web. Thickness, density, surface characteristics of the paper, printing speed and dryer set point temperature also effect heat flux. Moreover, a wrap angle of web 120 over a web guide surface is proportional to the contact area (A having a direct effect on heat transfer (q) since q=q"×A. Additionally, exceeding the power capacity of the heating elements results in a drop of heated surface temperature and can affect dryer controllability.

According to one embodiment, an adjustable web guide is provided to dynamically adjust the wrap angle to vary a contact area between web 120 and a surface of another web guide. In such an embodiment, adjusting the wrap angle adjusts the heat transfer from the web to the web guide (e.g., higher wrap angle increases heat transfer). Additionally, adjusting the wrap angle, and thereby the adjusting the normal force of web on web guide, may adjust the tension of web 120. In the embodiments described herein the web-guides may have different dimensions, sizes, shapes, profiles, textures and/or material to facilitate operation under different printing conditions (e.g., media types, thickness, materials, processing requirements, etc.).

Figure 2A:
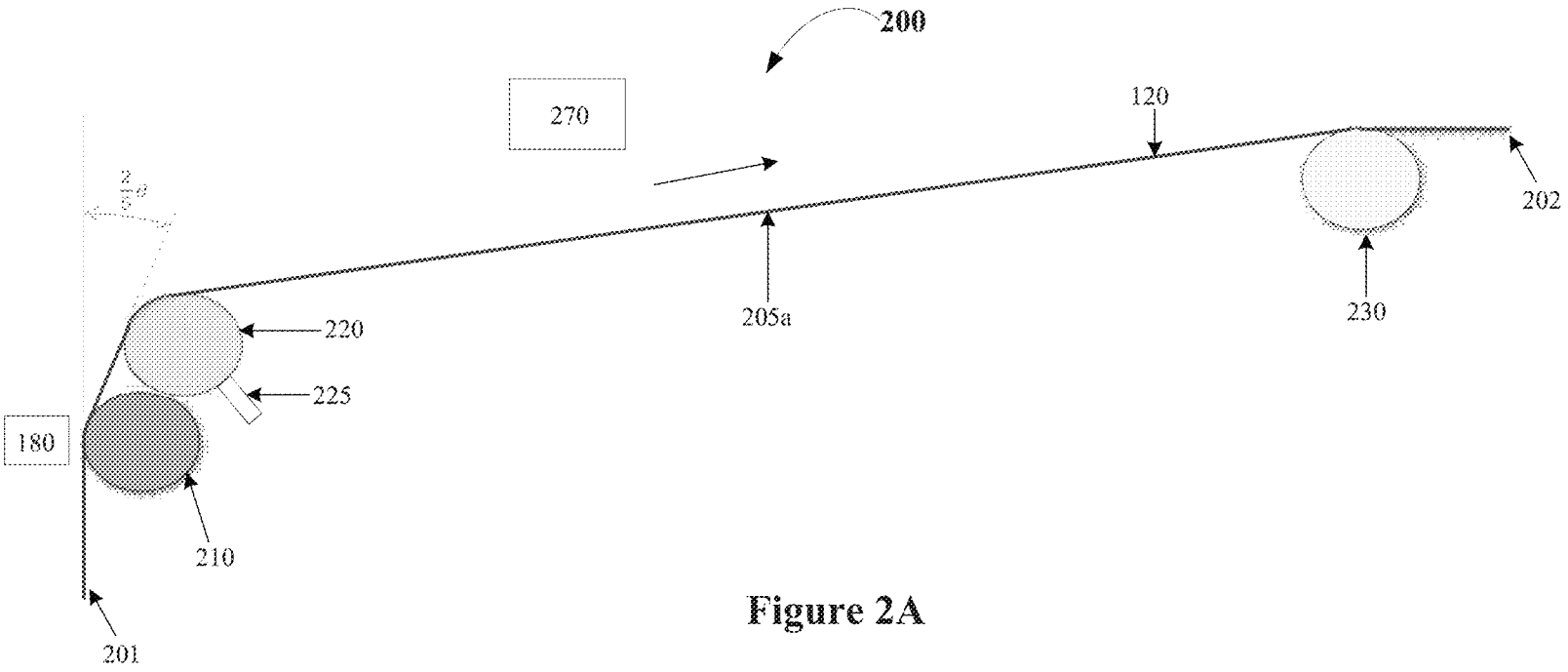
FIGS. 2A-2C illustrate embodiments of a web handling system.
Figure 2B:
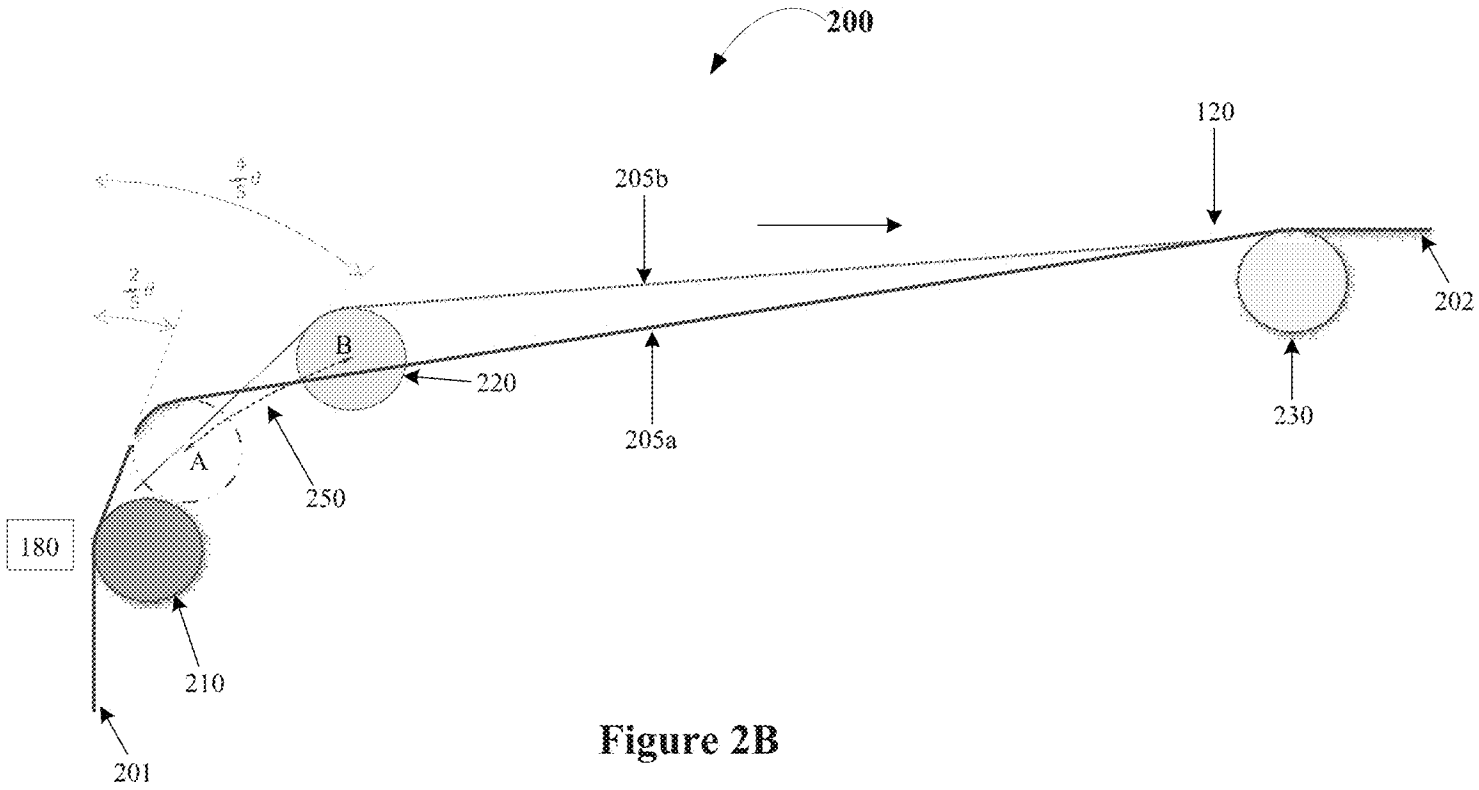
Figure 2C:
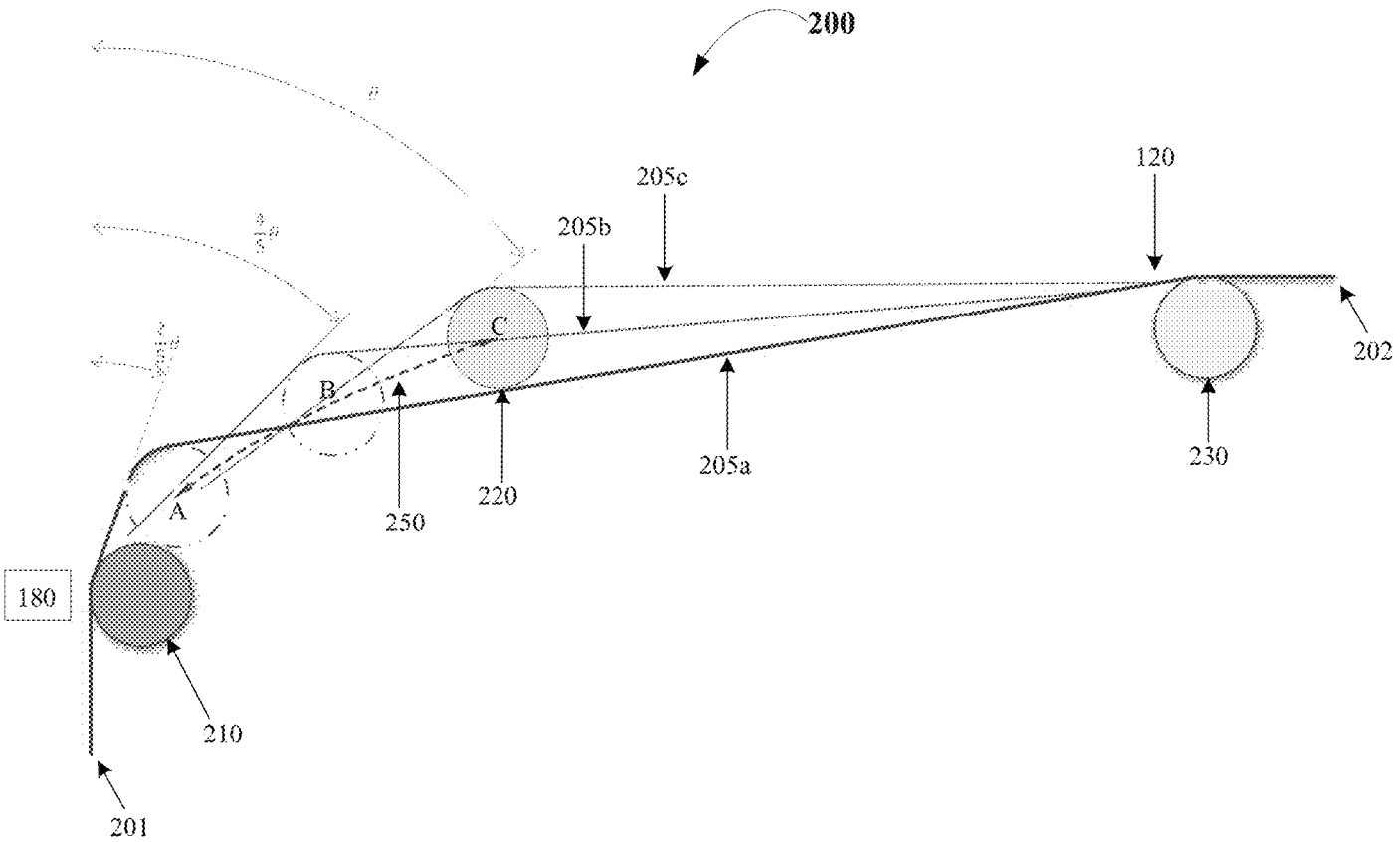

In a further embodiment, the path of web 120 (or web path) maintains a constant length upon the web guide 220 being adjusted between a plurality of positions on guide path 250. Maintaining a constant web path length ensures that the timing, speed and, depending on web-guide surface friction, tension of printing system 110 is also maintained. FIGS. 2A-2C illustrate embodiments of a web handling system 200.

As shown in FIG. 2A, system 200 includes web 120 being conveyed via a path 205*a* between a web guide 210 and a web guide 230. Web 120 enters system 200 at an entrance 201 and travels through to an exit 202. In other embodiments, web 120 may enter system at exit 202 and travel through to an entrance 202. In one embodiment, web guide 210 is a wrap angle web guide that contacts web 120 to transfer heat to (or from) web 120. Thus, web guide 210 is comprised of a thermally conductive material that may be heated or cooled to provide for heat transfer with web 120. In a further embodiment, web guide 210 may be implemented to adjust tension of web 120 by changing wrap angle (e.g., higher wrap angle increases normal force which is proportional to frictional force).

According to one embodiment, web guide 210 provides a dynamic wrap angle (θ) between web 120 and the surface of web guide 210. In such an embodiment, the wrap angle may be adjusted between angle values 0°-45°. However in other embodiments, the wrap angle may be adjusted between 0°-170°.

System 200 also includes an adjustable web guide 220 that is implemented to adjust the wrap angle between web 120 and the surface of web guide 210 by moving web guide 220 to different positions between web guide 210 and web guide 230. In one embodiment, positions between which adjustable web guide 220 may move is determined by a guide path 250 that forms a continuous path through a plurality of points (e.g., point A to point B to point C).

In a further embodiment, the guide path 250 is non-concentric relative to web guide 210, and is geometrically predetermined such that the contact area width, and the tangential distance (e.g., web path 205) between, web guides 210, 220 and 230 remains substantially the same as web guide 220 changes positions. In such an embodiment, substantially the same is defined as a variation insufficient to cause noticeable changes in tension, timing and/or speed of the web 120 traversing web path 205 or physical damage to the web 120.

In yet a further embodiment, the movement of adjustable web guide 220 along the guide path 250 minimizes the length variation of a web path 205 (e.g., the length of web 120 traversing web guides 210 and 230). In such an embodiment, web path 205 may be defined as a path of a taut (or tight) web in contact with web guides 210, 220 and 230.

As shown in FIG. 2A, adjustable web guide 220 is at a position resulting in a web path 205 at a position (a) (or 205A) and a wrap angle is ⅖θ. According to one embodiment, adjustable web guide 220 is moved along the guide path 250 via one or more guideways (e.g., slots, channels, cams or arms), not shown and/or an actuator (or motor) 225 coupled to web guide 220. In such an embodiment, actuators 225 facilitate the movement of adjustable web guide 220 upon receiving a signal from a controller 150 (shown in FIG. 1), as will discussed in more detail below. In other embodiments adjustable web guide 220 may be manually moved along the guide path 250.

FIG. 2B illustrates one embodiment of system 200 upon adjustable web guide 220 being adjusted to form a wrap angle of ⅘θ. As shown in FIG. 2B, adjustable web guide 220 has moved from a first position (A) to a second position (B) along guide path 250, which results in the web path 205 being moved to a position (b) (or 205*b*). However after movement to position 205*b*, the length of the web path remains the same (e.g., the length of web path 205*b* is equivalent to the length of web path 205*a*).

FIG. 2C illustrates one embodiment of system 200 upon adjustable web guide 220 being further adjusted to form a wrap angle of θ. As shown in FIG. 2C, adjustable web guide 220 has moved from the second position (B) to a third position (C) along guide path 250. This movement results in web path 205 moving to a position (c) (or 205*c*). After movement to position 205*c*, the length of the web path maintains the same length (e.g., the length of web path 205*c* is equivalent to the length of web path 205*b*, which is equivalent to the length of web path 205*a*). Accordingly, the web path 205 length remains constant throughout the adjustment of adjustable web guide 220.

As shown in FIGS. 2A-2C, system 200 is implemented in a drying application in which web guides 210, 220 and 230 contact web 120 on the same side of web path 205. However in other applications, adjustable web guide 220 may contact a different side of web 120 than web guides 210 and 230.

As discussed above, adjustable web guide 220 may be adjusted by one or more actuators 225 upon receiving a signal from controller 150. Controller 150 may initiate a web guide 220 adjustment upon receiving input from one or more sensors 180 or other devices (e.g. the printer 110) operable within printing system 100, or via user input from a graphical user interface (GUI) 170 (shown in FIG. 1).

Sensors 180 (FIG. 1) within the web handling system 140 may include rotary encoders, presence, position, velocity, acceleration or temperature type sensors. Further, the GUI 170 may provide an operator with system control and status. Control may be linked to printing system configuration snapshots for further automation. In other embodiments, controller 150 may be located outside of web handling system 140.

In one embodiment, controller 150 may receive one or more settings (e.g., temperature, paper type, printing system configuration snapshot settings) as input from an operator via the GUI 170 and automatically adjust the wrap angle based on the received settings. For instance, controller 150 may transmit signals, in response to receiving the temperature settings, indicating that web guide 220 is to move from position A to position B on guide path 250 upon determining that the wrap angle is to be adjusted.

In another embodiment, controller 150 may receive input from system 200 and adjust the wrap angle accordingly. In such an embodiment, one or more sensors 180 may be included to measure the surface temperature of web guide 210 and transmit the measurements to controller 150. In response, controller 150 facilitates the adjustment of adjustable web guide 220 via actuators 225. For example, controller 150 may determine that the received temperature measurements are outside of a predetermined temperature threshold (e.g., higher or lower) for the current wrap angle setting, and computes an updated wrap angle value. As a result, controller 150 transmits the output signals to move web guide 220 to a position to achieve the computed wrap angle.

In still a further embodiment, controller 150 transmits one or more output signals to actuators 225 in order to trigger the adjustment of adjustable web guide 220. Actuators 225 may be directly or indirectly coupled to the axis of adjustable web guide 220 and/or have an included or external driver to receive the signal from controller 150. In a further embodiment, system 200 may include a heat source 270 (e.g., radiant heat lamps, convection heat blower, etc.). Though shown separate from web guide 210, embodiments may feature heat source 270 located within web guide 210. In such an embodiment, controller 150 may monitor the duty cycle of the heat source 270 and adjust adjustable web guide 220 to adjust the wrap angle of web guide 210 based on the duty cycle. In one embodiment, web guide 220 may be adjusted to reduce the wrap angle as the duty cycle of heat source 270 increases.

As discussed above, the wrap angle may be adjusted based on tension (or friction measurements), rather than heat transfer. In such an embodiment, adjustable web guide 220 is adjusted to change a wrap angle ratio between web guides 210 and 230 having different kinetic friction coefficients. As a result, tension drop (or rise) between web guides 210 and 230 is changed, while the total wrap angle remains constant. In this embodiment, controller 150 may adjust web guide 220 to maintain a desired tension drop (or rise) between web guides 210 and 230.

Figure 3:
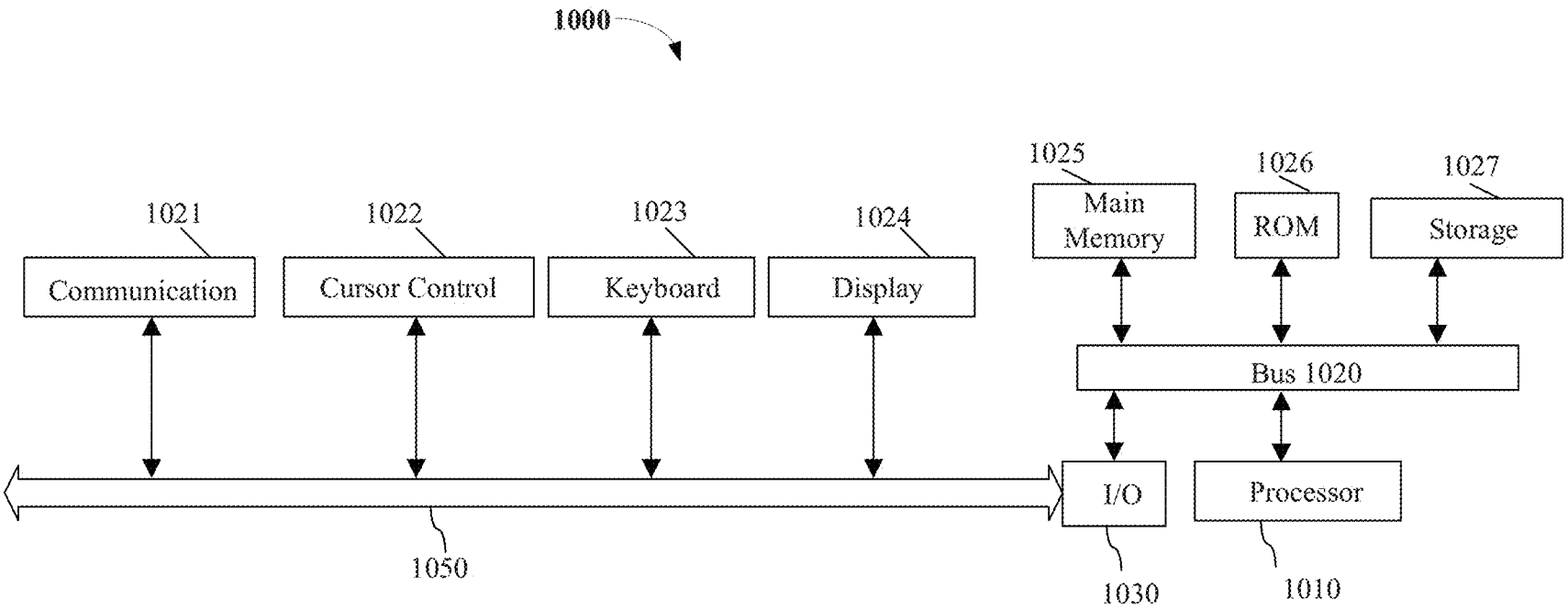
FIG. 3 illustrates one embodiment of a computer system.

FIG. 3 illustrates a computer system 1000 on which printing system 130 and/or controller 150 may be implemented. Computer system 1000 includes a system bus 1020 for communicating information, and a processor 1010 coupled to bus 1020 for processing information.

Computer system 1000 further comprises a random access memory (RAM) or other dynamic storage device 1025 (referred to herein as main memory), coupled to bus 1020 for storing information and instructions to be executed by processor 1010. Main memory 1025 also may be used for storing temporary variables or other intermediate information during execution of instructions by processor 1010. Computer system 1000 also may include a read only memory (ROM) and or other static storage device 1026 coupled to bus 1020 for storing static information and instructions used by processor 1010.

A data storage device 1027 such as a magnetic disk or optical disc and its corresponding drive may also be coupled to computer system 1000 for storing information and instructions. Computer system 1000 can also be coupled to a second I/O bus 1050 via an I/O interface 1030. A plurality of I/O devices may be coupled to I/O bus 1050, including a display device 1024, an input device (e.g., an alphanumeric input device 1023 and or a cursor control device 1022). The communication device 1021 is for accessing other computers (servers or clients). The communication device 1021 may comprise a modem, a network interface card, or other well-known interface device, such as those used for coupling to Ethernet, token ring, or other types of networks.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. A web handling apparatus, comprising:

an entrance to receive a print medium;

a first web guide to engage the print medium;

a second web guide to engage the print medium to adjust a contact area between the first web guide and the print medium upon moving between a plurality of points on a guide path, wherein the contact area has a first angle value when the second web guide is located at a first position on the guide path, and has a second angle value when the second web guide is located at a second position on the guide path, wherein the length of a web path remains the same as the web guide changes positions between the second position and the first position and adjusting a contact area between the first web guide and the print medium is based on a temperature of the first web guide;

a guideway coupled to the second web guide to enable movement of the second web guide between the plurality of points on the guide path;

a third web guide to engage the print medium to form the web path with the first web guide; and an exit.

2. The web handling apparatus of claim 1, wherein the second web guide moves between the plurality of points on the guide path between the first web guide and the third web guide.

3. The web handling apparatus of claim 2, wherein the web path has a first position when the second web guide is located at the first position on the guide path and has a second position when the second web guide is located at the second position on the guide path.

4. The web handling apparatus of claim 1, further comprising an actuator coupled to the second web guide to move the second web guide between the plurality of points on the guide path.

5. The web handling apparatus of claim 4, wherein the actuator receives one or more signals from a controller to move the second web guide between the plurality of points on the guide path.

6. The web handling apparatus of claim 1, wherein the first and second web guides may comprise at least one of a roller and a bar.

7. The web handling apparatus of claim 1, further comprising a printer to receive the print medium and mark the print medium.

8. The web handling apparatus of claim 1, wherein the length of the web path includes tangential portions.

9. The web handling apparatus of claim 1, wherein the web path corresponds to the path of a tight web.

10. A web handling system, comprising:

a web handling device, including:

an entrance to receive a print medium;

a first web guide to engage the print medium at a contact area;

a second web guide to engage the print medium to adjust the contact area between the first web guide and the print medium, wherein the contact area has a first angle value when the second web guide is located at a first position on the guide path, and has a second angle value when the second web guide is located at a second position on the guide path, wherein the length of a web path remains the same as the web guide changes positions between the second position and the first position and adjusting a contact area between the first web guide and the print medium is based on a temperature of the first web guide;

a guideway coupled to the second web guide to enable movement of the second web guide between the plurality of points on the guide path;

an exit; and a controller, communicatively coupled to the web handling device, to transmit one or more signals to an actuator to move the second web guide between a plurality of points on a guide path.

11. The web handling system of claim 10, wherein the actuator moves the second web guide from a first position on the guide path to a second position on the guide path in response to receiving the one or more signals.

12. The web handling system of claim 11, wherein the web handling device further comprises an actuator coupled to the second web guide to move the second web guide between the plurality of points on a guide path in response to receiving the one or more signals.

13. The web handling system of claim 11, further comprising a third web guide to engage the print medium to form the web path with the first web guide.

14. The web handling system of claim 13, wherein the second web guide moves between the plurality of points on the guide path between the first web guide and the third web guide.

15. The web handling system of claim 14, wherein the web path has a first position when the second web guide is located at the first position on the guide path and has a second position when the second web guide is located at the second position on the guide path.

16. The web handling system of claim 10, further comprising a printer to receive the print medium and mark the print medium.

17. The web handling system of claim 10, wherein the length of the web path includes tangential portions.

18. The web handling system of claim 10, wherein the web path corresponds to the path of a tight web.

* * * * *